US005240425A

United States Patent [19]

Sato et al.

[11] Patent Number: 5,240,425

[45] Date of Patent: Aug. 31, 1993

[54] ELECTRICAL CONNECTOR

[75] Inventors: Kensaku Sato; Naohisa Nakata, both of Tokyo, Japan

[73] Assignee: Hirose Electric Co., Ltd., Tokyo, Japan

[21] Appl. No.: 943,681

[22] Filed: Sep. 11, 1992

[30] Foreign Application Priority Data

Sep. 20, 1991 [JP] Japan ..... 3-84312[U]
Sep. 20, 1991 [JP] Japan ..... 3-84314[U]

[51] Int. Cl.[5] ..... H01R 13/655
[52] U.S. Cl. ..... 439/100; 439/108
[58] Field of Search ..... 439/92, 98–100, 439/108

[56] References Cited

U.S. PATENT DOCUMENTS 4,500,157 2/1985 Huffnagle et al. ..... 439/92

FOREIGN PATENT DOCUMENTS 3408825 9/1985 Fed. Rep. of Germany ..... 439/98
65075 3/1990 Japan ..... 439/98
4460 1/1991 Japan ..... 439/108

*Primary Examiner*—Gary F. Paumen
*Attorney, Agent, or Firm*—Kanesaka & Takeuchi

[57] ABSTRACT

An electrical connector assembly includes a support bracket (5) to be attached to a conductive object (90) and an electrical connector (1) mounted on the support bracket. The electrical connector includes a dielectric housing (3); at least one terminal unit (4) connected to a shield wire of a shielded cable (38); a ground terminal (6) in contact with the terminal unit; and a ground plate (87) mounted on the support bracket for interconnecting the ground terminal to the conductive object, thereby grounding the shield wire to the conductive object.

3 Claims, 15 Drawing Sheets

ELECTRICAL CONNECTOR

BACKGROUND OF THE INVENTION

1. Field of the Invention

The present invention relates to electrical connectors for use in electronics equipment, etc.

2. Description of the Related Invention

FIG. 39 shows an electrical connector of this type. A pair of terminal units 107 are mounted in terminal unit mounting apertures 101 of an electrical connector 100. The terminal units 107 have a shield jacket 104 connected to the shield wire 103 of a shielded cable 102. The terminal unit 107 has an inner terminal 106 supported by a dielectric body 105. A ground terminal 108 is attached to the electrical connector 100 to interconnect the terminal units 107. The electrical connector 100 is attached to a conductive object 110 by inserting a clip 109 of the electrical connector 100 into the conductive object 110. The shield wire 103 is grounded by connecting the washer 112 of a lead wire 111 to the conductive object 110 with a bolt 113.

In the above connector, however, after the connector is attached to the conductive object 110 by inserting the clip 109, the washer 112 of the lead wire 111 is bolted to the conductive object 110. Thus, it requires two steps to attach the connector to the conductive object 110, and is complex and difficult to handle.

SUMMARY OF THE INVENTION

Accordingly, it is an object of the invention to provide an electrical connector which is simple in structure and easy to handle.

According to the invention there is provided an electrical connector assembly includes a support bracket to be attached to a conductive object and an electrical connector mounted on the support bracket. The electrical connector includes a dielectric housing; at least one terminal unit connected to a shield wire of a shielded cable; a ground terminal in contact with the terminal unit; and a ground plate mounted on the support bracket for interconnecting the ground terminal to the conductive object, thereby grounding the shield wire to the conductive object.

With the above structure, it is possible to ground the shield wire of a shielded cable to a conductive object via the ground terminal and the ground plate. When a mating connector is connected to the electrical connector, the shield wire of the mating connector is brought into contact with the terminal unit of the electrical connector and grounded to the conductive object via the ground terminal and the ground plate. In this way, the grounding of the shield wire of a shielded cable is simplified, and its handling is made easier.

The above and other objects, features, and advantages of the invention will be more apparent from the following description when taken in conjunction with the accompanying drawings.

DESCRIPTION OF THE PREFERRED EMBODIMENT

Figure 1:
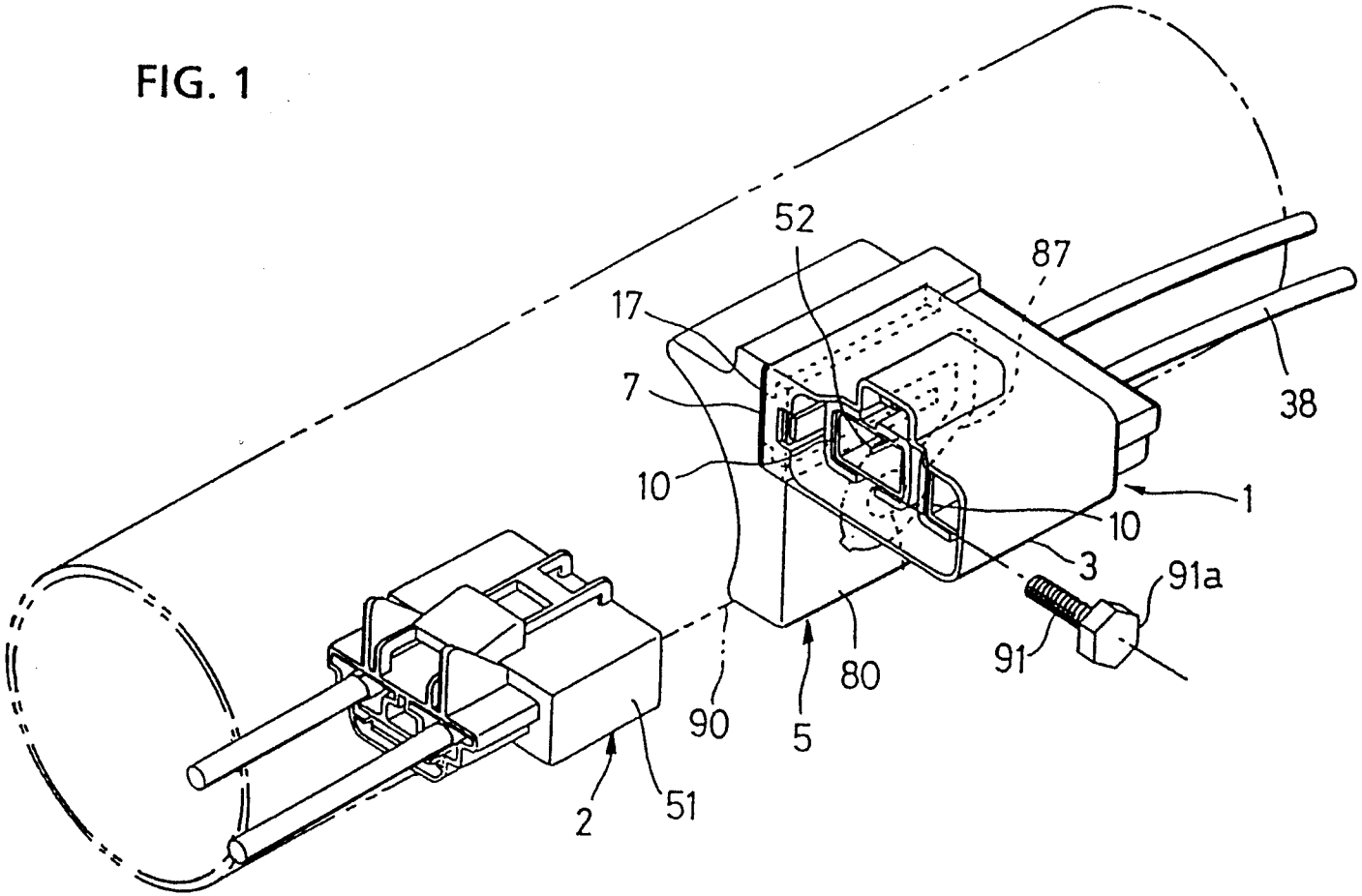
FIG. 1 is a perspective view of an electrical connector according to an embodiment of the invention.

In FIG. 1, an electrical connector assembly consists of a male connector 1, a female connector 2, and a support bracket 5 for attaching the male connector 1 to an object 90.

Figure 2:
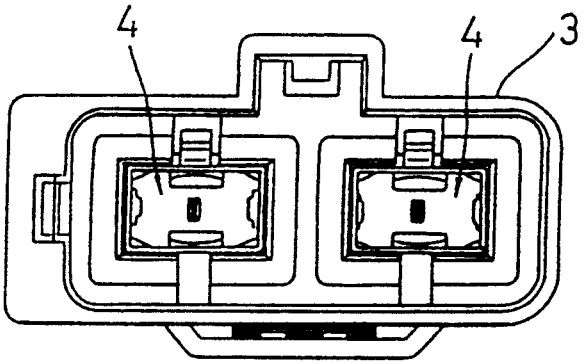
FIG. 2 is a front elevational view of a male connector.
Figure 3:
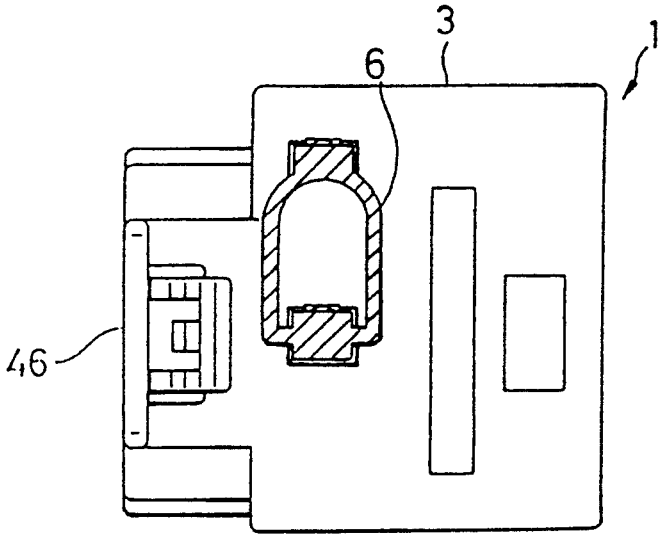
FIG. 3 is a bottom plan view thereof.
Figure 4:
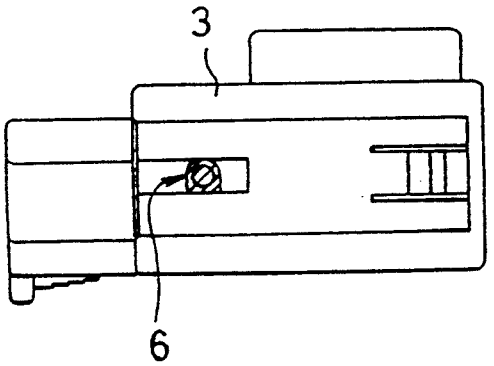
FIG. 4 is a side elevational view thereof.
Figure 5:
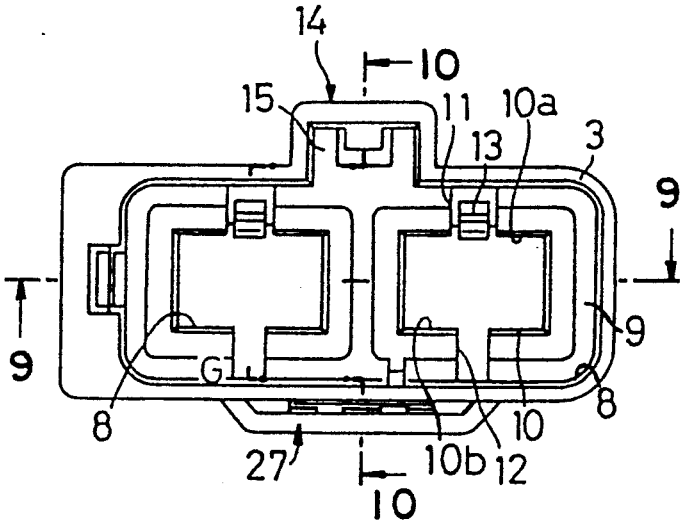
FIG. 5 is a front elevational view of a housing of the male connector.
Figure 6:
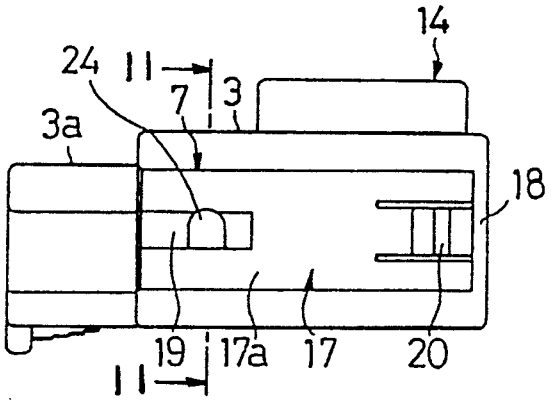
FIG. 6 is a side elevational view thereof.
Figure 7:
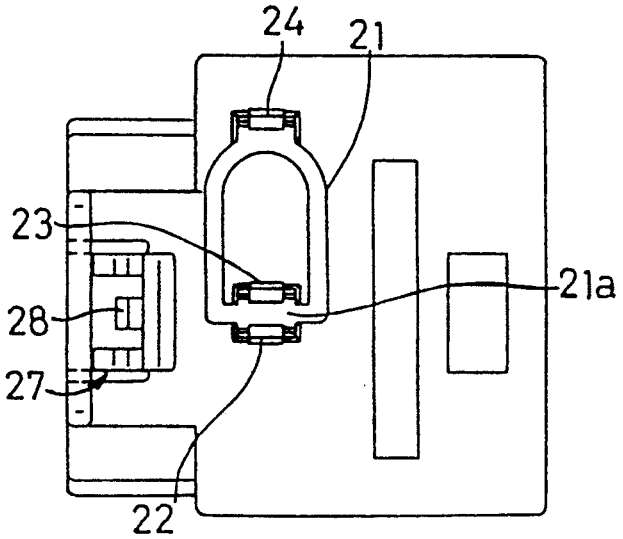
FIG. 7 is a bottom plan view thereof.
Figure 8:
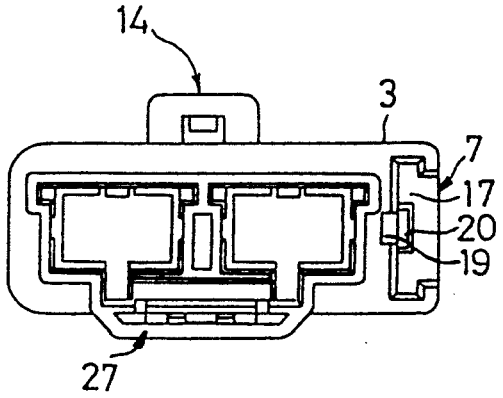
FIG. 8 is a rear elevational view thereof.
Figure 9:
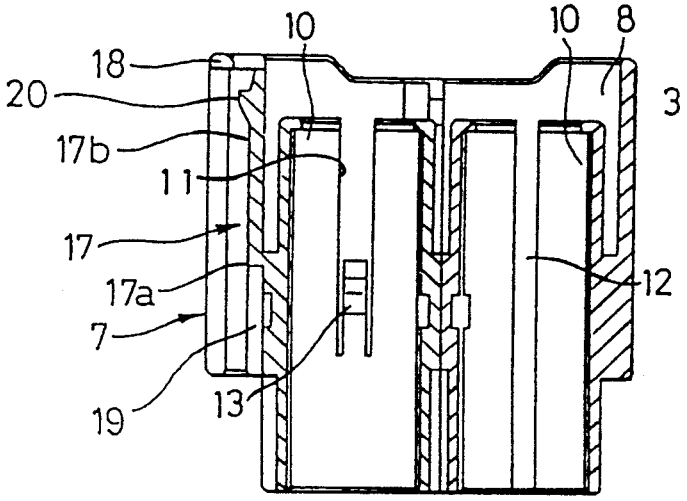
FIG. 9 is a sectional view taken along line 9—9 of FIG. 5.
Figure 10:
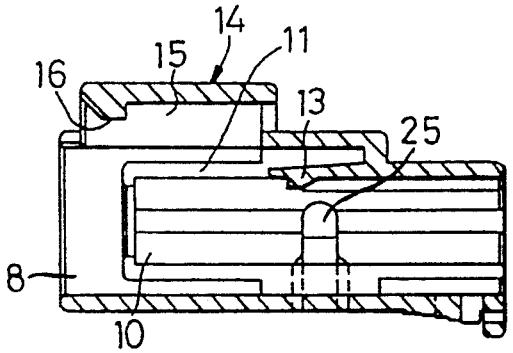
FIG. 10 is a sectional view taken along line 10—10 of FIG. 5.

In FIGS. 2-4, the male connector 1 includes a substantially rectangular housing 3, a pair of terminal units 4, and a ground terminal 6.

In FIGS. 5-11, the housing 3 has a bracket receiver 7 on the left side as viewed in FIG. 1. A fitting cavity 8 having a rectangular cross-section extends rearwardly from the front end of the housing 3. A pair of terminal unit mounting apertures 10 having a substantially square cross-section extend forwardly from the bottom 9 of the fitting cavity 8. A pair of lance grooves 11, 12 extend rearwardly from the front end of the upper and lower surfaces 10*a*, 10*b*, of each terminal unit mounting aperture 10. A lance member 13 extends forwardly from the bottom of the upper lance groove 11. A lock member 14 is formed on the top of the housing 3. The lock member 14 has a lock bar receiving cavity 15 which is formed by raising the upper surface of the housing 3 and an engaging projection 16 formed on the front portion of the lock bar receiving cavity 15.

Figure 11:
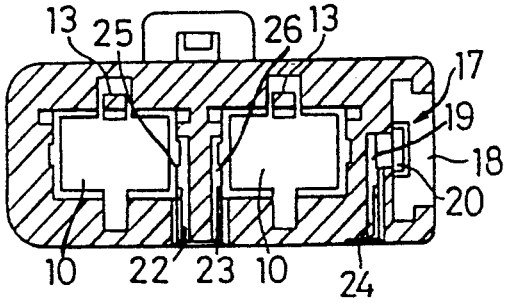
FIG. 11 is a sectional view taken along line 11—11 of FIG. 6.

The rear section 3*a* of the housing 3 is reduced. A dovetail groove 17 extends forwardly from the rear end of the support bracket receiver 7 and terminates at a front wall 18. A lance member 20 is formed on the front portion of the floor 17*a* of the dovetail groove 17, and a channel 19 extends forwardly from the rear end to the midpoint of the floor 17*a*. A ground terminal receiving recess 21 is formed on the bottom of the housing 3. A leg receiving slot 24 and a pair of leg receiving slots 22, 23 are formed on the left and right sides of the ground terminal receiving recess 21, respectively. As best shown in FIG. 11, the leg receiving slots 22, 23 communicate with ground terminal receiving channels 25, 26 formed on the left and right sides of the right and left terminal unit mounting apertures 10, respectively, while the leg receiving aperture 24 communicates with the channel 19 on the bracket receiver 7. A double engaging member receiving recess 27 is formed on the bottom of the housing 3 so as to communicate with the lance grooves 12 on the lower surface 10*b* of the terminal unit mounting apertures 10. A lance member 28 is formed on the upper surface of the double engaging member receiving recess 27.

Figure 12:
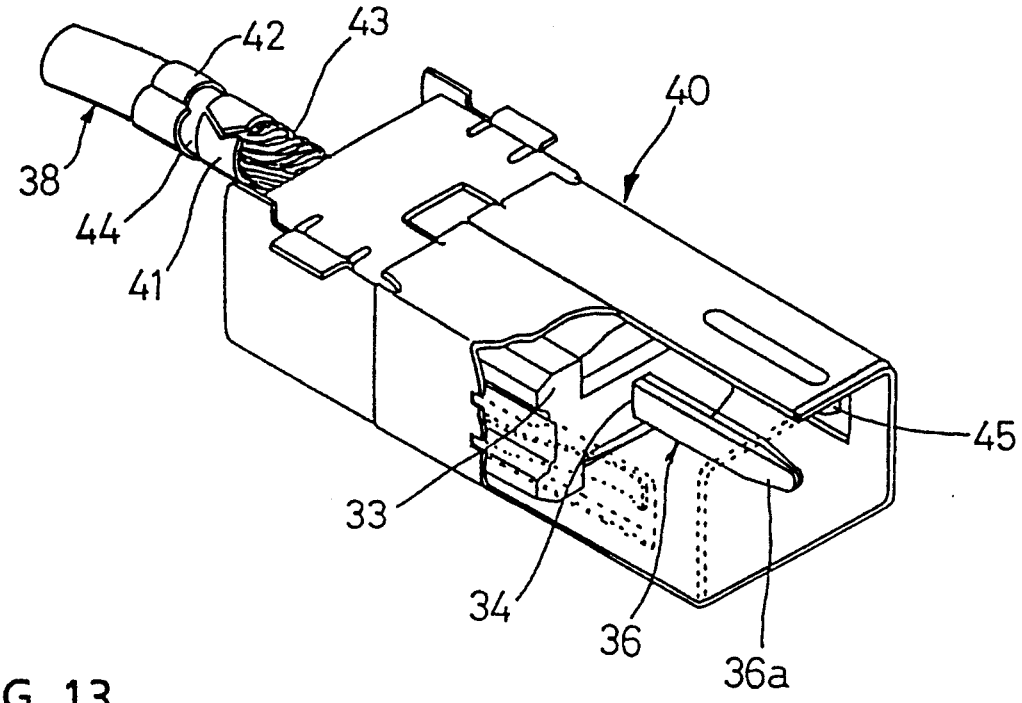
FIG. 12 is a perspective view of a male terminal unit.
Figure 13:
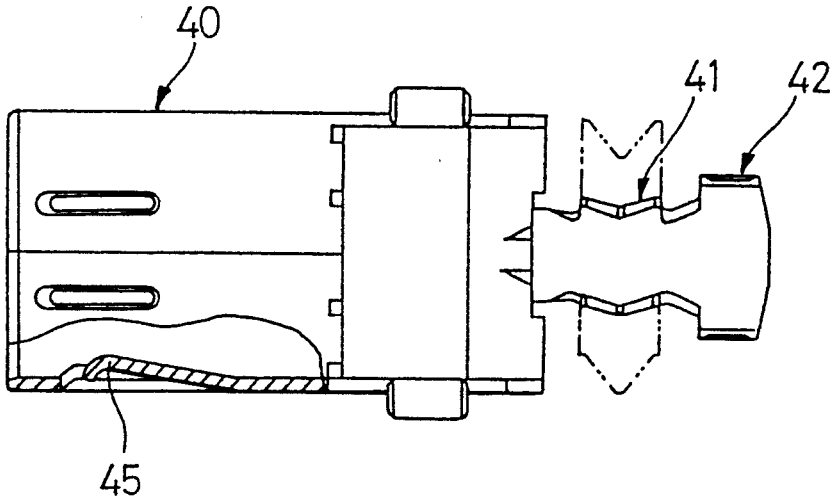
FIG. 13 is a top plan view of a shield jacket of the male terminal unit.
Figure 14:
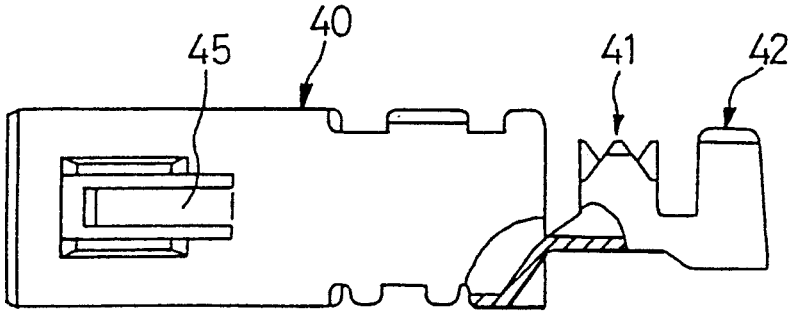
FIG. 14 is a side elevational view thereof.

In FIGS. 12–14, the terminal unit 4 includes a dielectric body 33 which has a central terminal mounting aperture 34. The terminal mounting aperture 34 has a lance on the inner wall. A male terminal 36 is inserted into the terminal mounting aperture 32, with the engaging projection of the male terminal 36 engaging the lance, such that the contact portion 36*a* of the male terminal 36 projects forwardly from the dielectric body 33. The male terminal 36 is crimped to the core wire of a shielded cable 38. A shield jacket 40, which surrounds the dielectric body 33 and the male terminal 36, has a shield crimping member 41 crimped to a shield wire 43 of the shielded cable 38 and a sheath crimping member 42 crimped to a sheath 44 of the shielded cable 38. A pair of contact fingers 45 are cut out of the side walls of the shield jacket 40. A pair of such terminal units 4 are mounted in the terminal unit mounting apertures 10 such that the side walls of the shield jackets 40 are brought into contact with the contact points 30*b*, 31*b* of the terminal legs 30, 31 of the ground terminal 6, respectively. Consequently, the shield wires 43 of the shielded cables 38 are connected to the ground terminal 6 via the shield jacket 40 and the contact points 31*b*, 30*b*.

Figure 15:
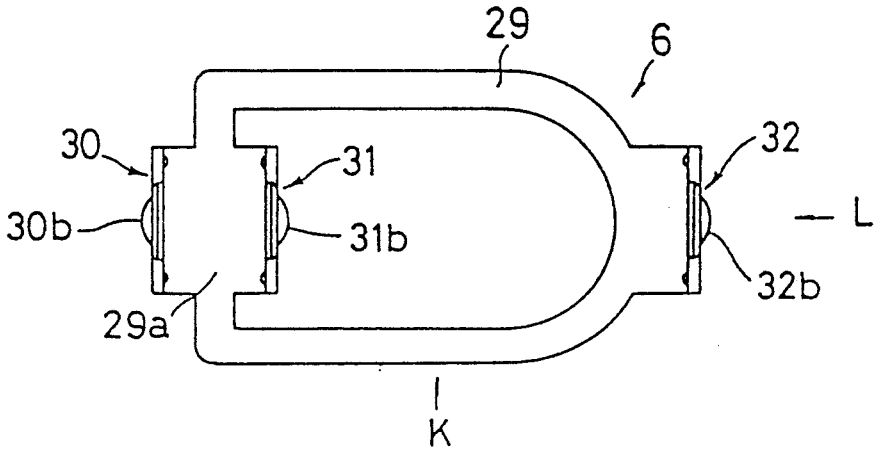
FIG. 15 is a top plan view of a ground terminal.
Figure 16:
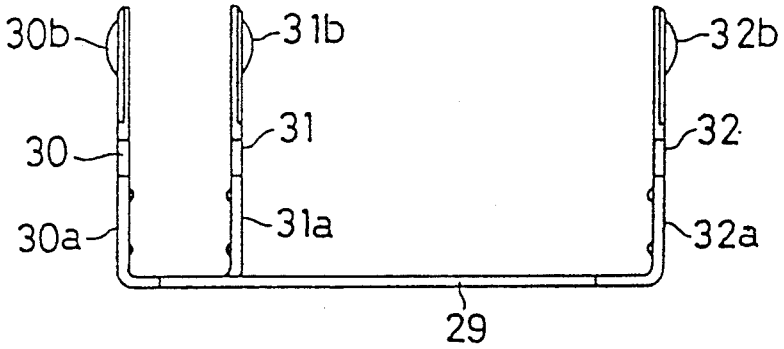
FIG. 16 is the ground terminal as viewed from an arrow K of FIG. 15.
Figure 17:
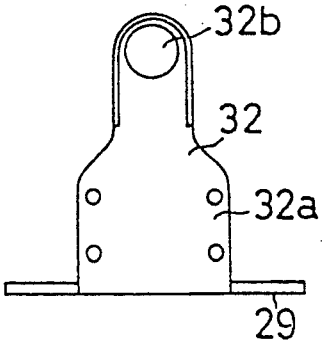
FIG. 17 is the ground terminal as viewed from an arrow L of FIG. 15.

In FIGS. 15–17, the ground terminal 6 has a loop-shaped interconnecting member 29. A pair of terminal legs 30, 31 and a terminal leg 32 extend upwardly from the an enlarged portion 29 of the interconnecting member 29 and a portion opposite to the enlarged portion 29, respectively. Each terminal leg 30, 31, 32 has a press-fit member 30*a*, 31*a*, 32*a* on the base portion and a contact point 30*b*, 31*b*, 32*b* at the front portion. The ground terminal 6 is mounted on the housing 3 by fitting the interconnecting member 29 and the terminal legs 30, 31, 32 into the ground terminal receiving recess 21 and the leg receiving slots 22, 23, 24, respectively, such that the contact points 30*b*, 31*b*, and 32*b* project into the terminal unit mounting aperture 10 and the channel 19, respectively.

Figure 18:
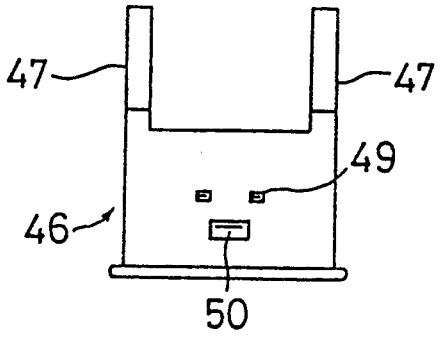
FIG. 18 is a bottom plan view of a double engaging member.
Figure 19:
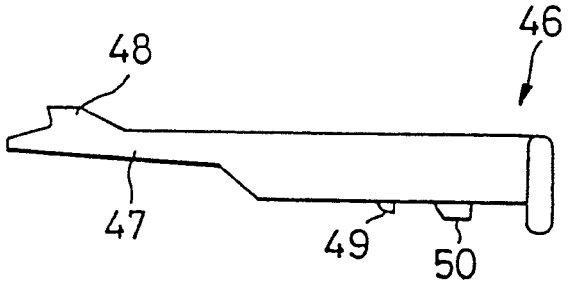
FIG. 19 is a side elevation of thereof.

In Figs. 18 and 19, the double engaging member 46, which is inserted into the double engaging member receiving recess 27 on the bottom of the housing 3, has a pair of leg members 47 each having an engaging projection 48 at the front portion. The double engaging member 46 also has an engaging projection 49 and a stopper 50 on the base portion. The double engaging member 46 is inserted in the double engaging member receiving recess 27 such that the engaging projection 49 engages the lance member 28 while the leg members 47 are inserted in the lower lance grooves 12 of the terminal unit mounting apertures 10, with the engaging projections 48 abutting on the rear ends of the terminal units 4.

Figure 20:
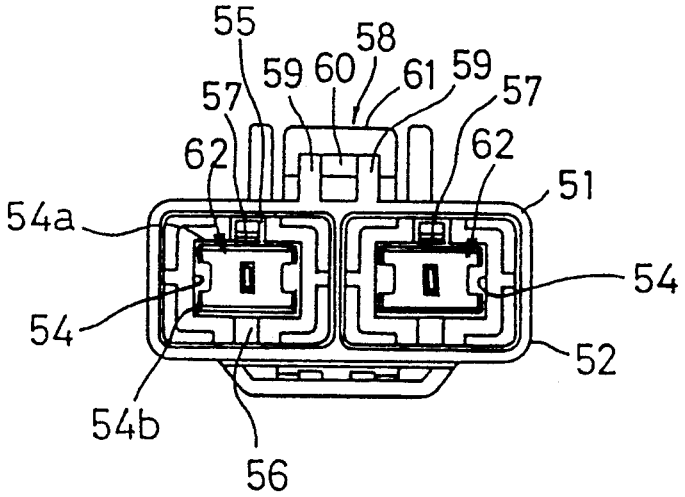
FIG. 20 is a front elevational view of a female connector.
Figure 21:
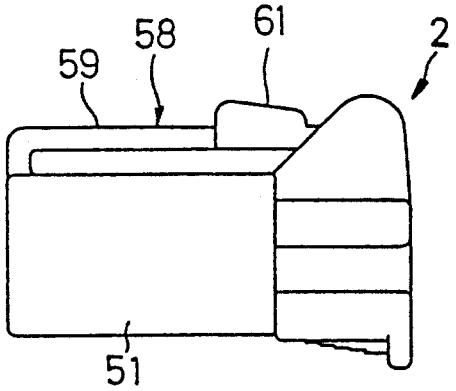
FIG. 21 is a side elevational view thereof.
Figure 22:
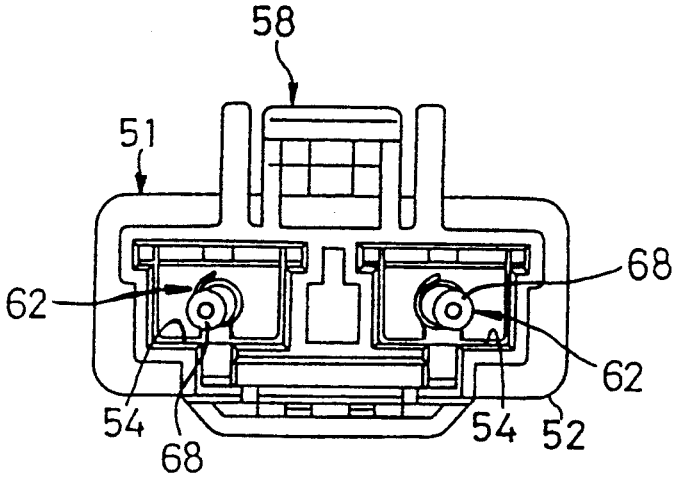
FIG. 22 is a rear elevational view thereof.
Figure 23:
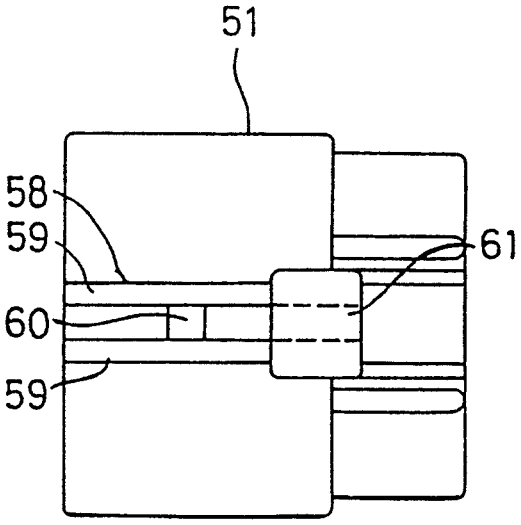
FIG. 23 is a top plan view thereof.
Figure 24:
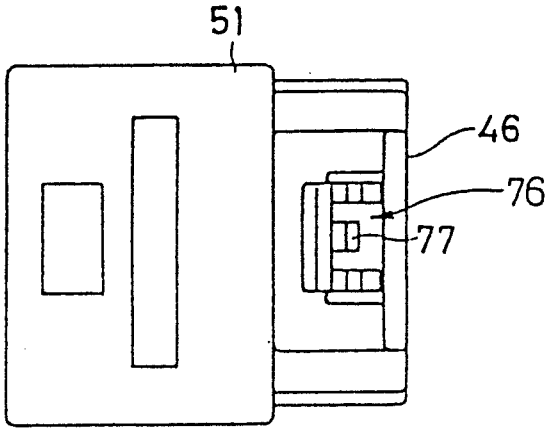
FIG. 24 is a bottom plan view thereof.
Figure 25:
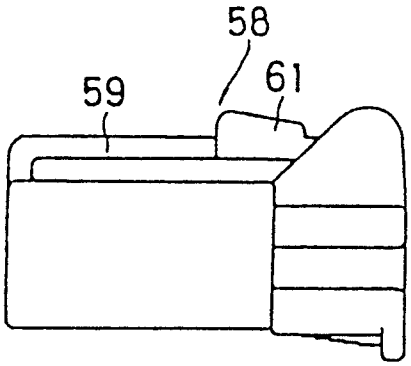
FIG. 25 is a side elevational view of a housing of the female connector.
Figure 26:
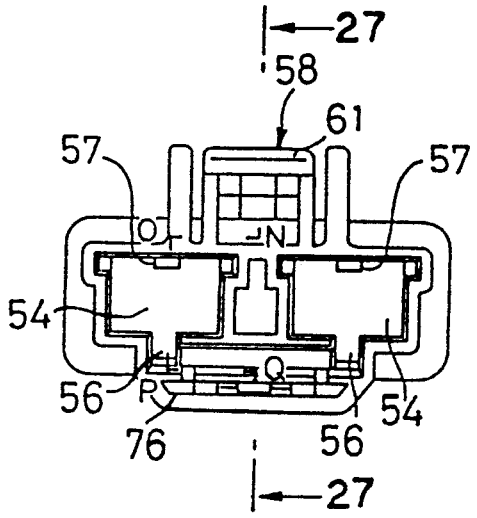
FIG. 26 is a rear elevational view thereof.
Figure 27:
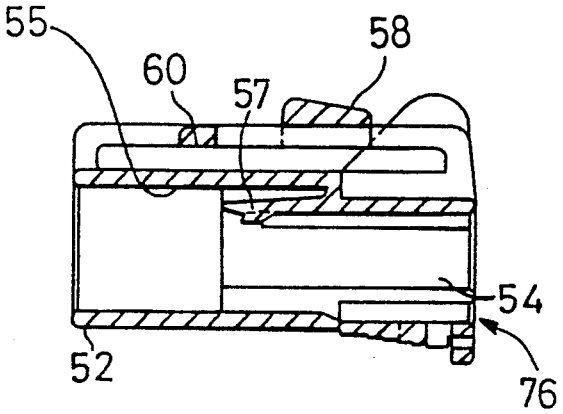
FIG. 27 is a sectional view taken along line 27—27 of FIG. 26.

In FIGS. 20–22, the female connector 2 includes a substantially rectangular housing 51 and a pair of female terminal units 62.

In FIGS. 23–27, the housing 51 has a fitting cavity 52 extending rearwardly from the front end thereof. A pair of terminal unit mounting apertures 54 having a substantially square cross-section extend forwardly from the rear end of the housing 3 into the fitting cavity 52. Each terminal unit mounting aperture 54 has a pair of lance grooves 55, 56 extending in the axial direction on the upper and lower surfaces thereof. The upper lance groove 55 has a lance member 57 extending forwardly from the middle thereof. A lock member 58 is formed on the top of the housing 51. The lock member 58 includes a pair of lock bars 59 extending rearwardly from the front end of the housing 51. The lock bars 59 are interconnected with a cross-bar 60 and provided with a push member 61 thereon.

Figure 28:
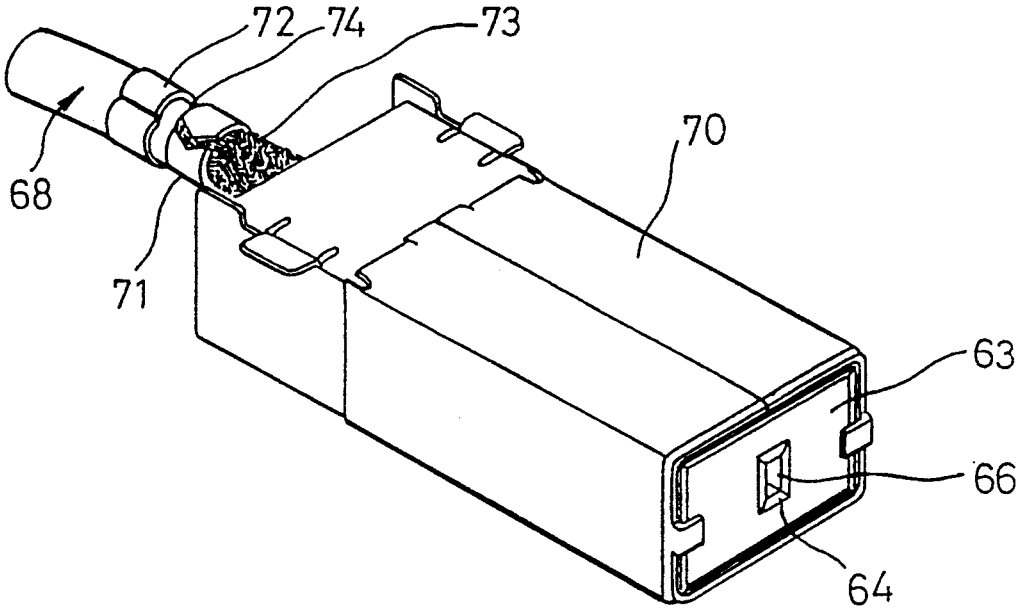
FIG. 28 is a perspective view of a female terminal unit for the female connector.
Figure 29:
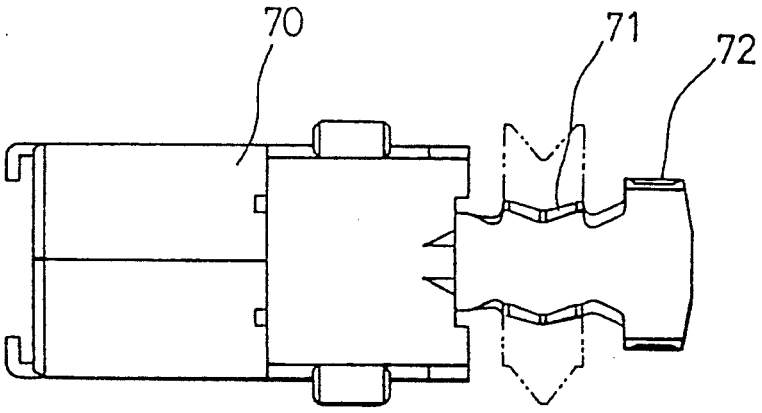
FIG. 29 is a top plan view of a shield jacket for the female terminal unit.
Figure 30:
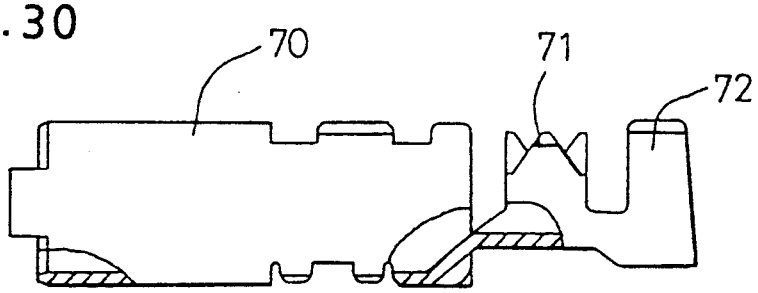
FIG. 30 is a side elevational view thereof.

In FIGS. 28–30, the female terminal unit 62 includes a dielectric body 63 with a central terminal mounting aperture 64 having a lance member on its inner wall. A female terminal 66 is inserted in the terminal mounting aperture 64 such that its engaging projection engages the lance member. The female terminal 66 is crimped to the core wire of a shielded cable 68. A shield jacket 70 surrounding the dielectric body 63 has a shield crimping member 71 crimped to the shield wire 73 of the shielded cable 68 and a sheath crimping member 72 crimped to a sheath 74 of the shielded cable 68. A pair of such terminal units 62 are mounted in the terminal units mounting apertures 54. The double engaging member 46 of FIGS. 18–19 are inserted in the double engaging member receiving recess 76 on the bottom of the housing 51 such that the engaging projection 49 engages the lance member 77 of the double engaging member receiving recess 76 while the leg members 47 are inserted in the lance grooves 56 with the projections 48 supporting the rear ends of the terminal units 62.

Figure 31:
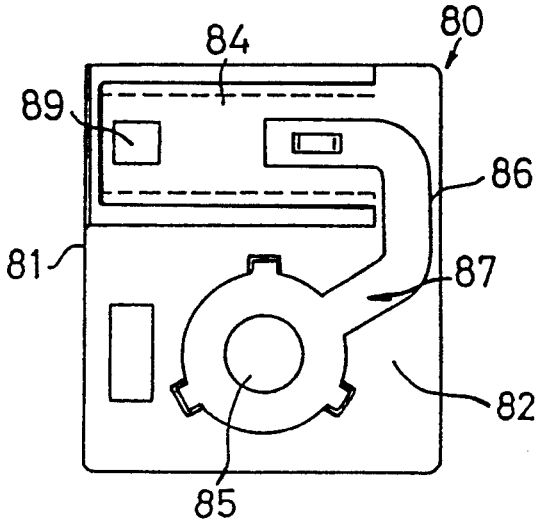
FIG. 31 is a right side elevational view of a support bracket.
Figure 32:
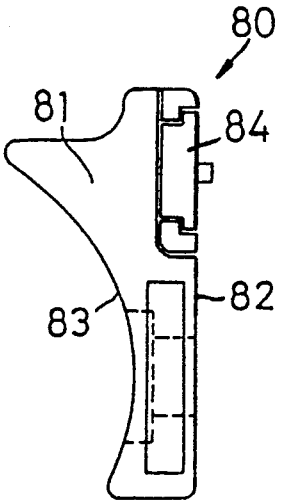
FIG. 32 is a front elevational view thereof.
Figure 33:
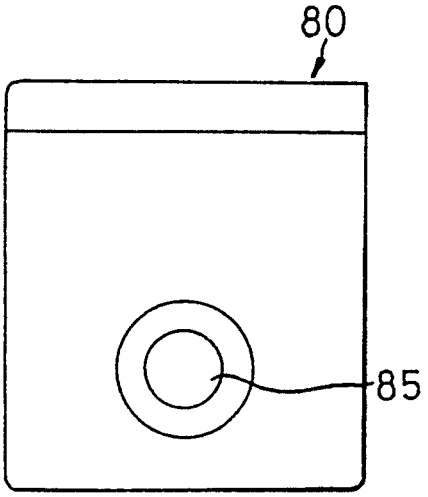
FIG. 33 is a left side elevational view thereof.

In FIGS. 31–33, the support bracket 80 has a bracket body 81 made from a dielectric material so as to have a flat right side surface 82 and a curved left side surface 83 which abuts on a conductive object; e.g., a metal pipe 90. An engaging rail 84 having a T-shaped cross-section extends forwardly from the upper rear end of the flat surface 82, providing a connection section. An attaching aperture 85 is formed below the engaging rail 84, providing a mounting section.

Figure 34:
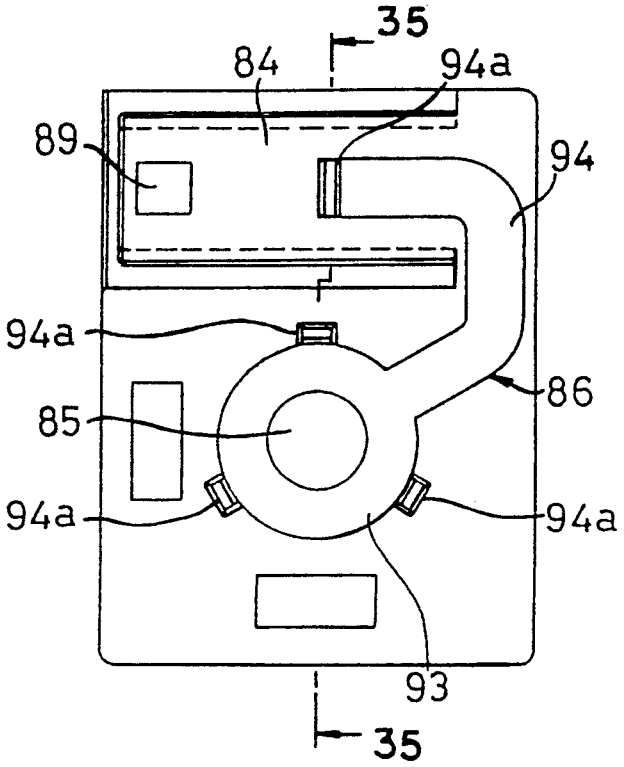
FIG. 34 is a right side elevational view of a bracket body of the support bracket.
Figure 35:
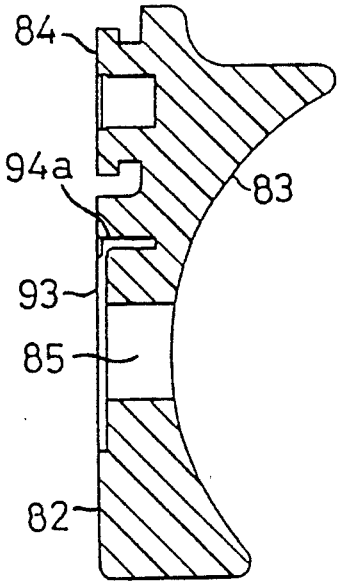
FIG. 35 is a sectional view taken along line 35—35 of FIG. 34.

In FIGS. 34 and 35, a ground plate mounting groove 86 extends from the base portion of the engaging rail 84 to an attaching aperture 85 formed on the flat surface 82. The ground plate mounting groove 86 includes an annular portion 93 and a curved portion 94. Press-fit slots 94*a* are formed on the annular portion 93 and the end portion of the curved portion 94. A ground plate 87 is mounted in the ground plate mounting groove 86. An engaging recess 89 is formed on the front portion of the engaging rail 84.

Figure 36:
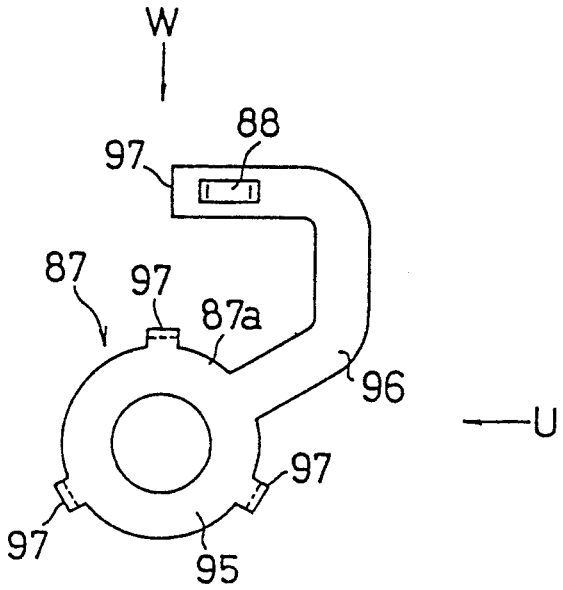
FIG. 36 is a top plan elevational view of a grounding plate.
Figure 37:
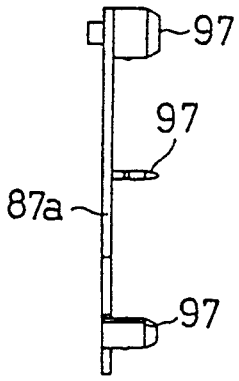
FIG. 37 is the ground plate as viewed from an arrow U of FIG. 36.
Figure 38:
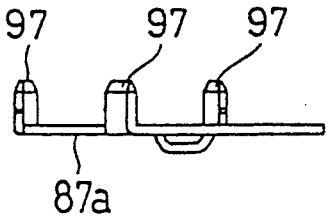
FIG. 38 is the ground plate as viewed from an arrow W of FIG. 36.
Figure 39:
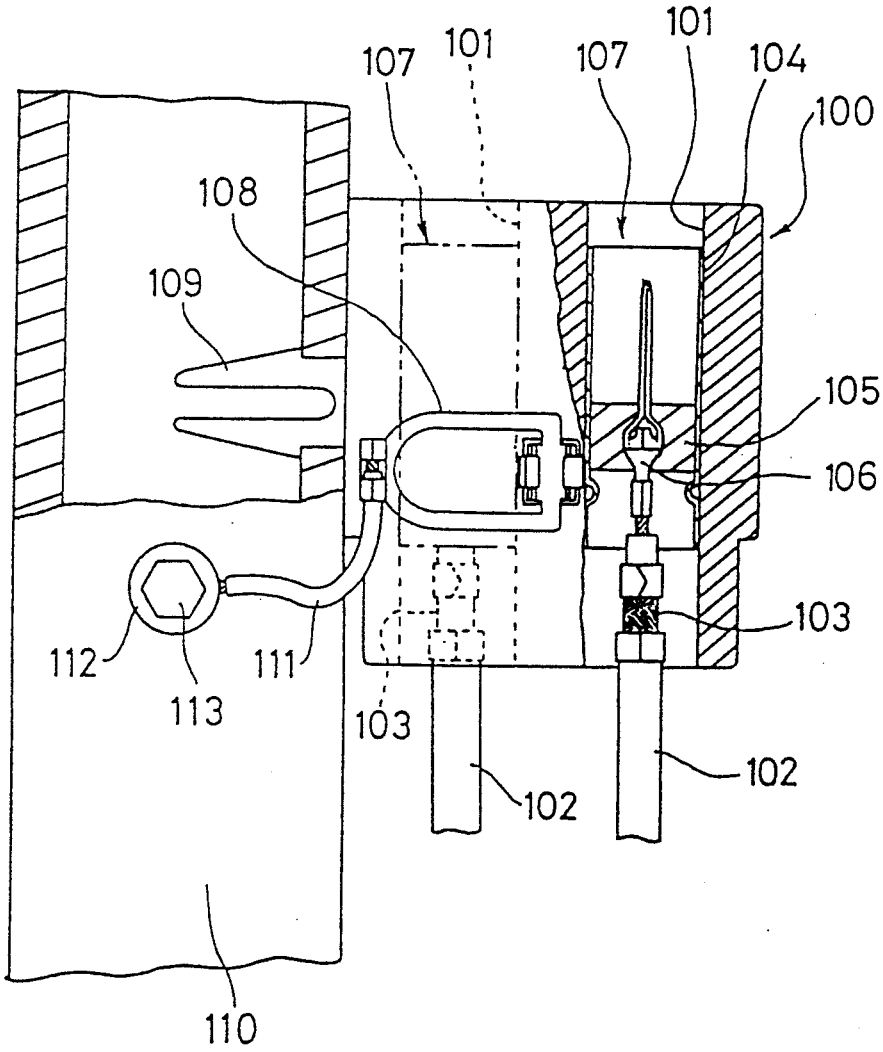
FIG. 39 is a side elevational view of an electrical connector of a related invention.

In FIGS. 36–38, the ground plate 87 has a plate body 87*a* which includes an annular member 95 and a curved member 96. Press-fit legs 97 are formed on the annular member 95 and the end of the curved member 96. A contact point 88 is formed on the end portion of the curved member 96. The ground plate 87 is mounted in the ground plate mounting groove 86 by press fitting the press-fit legs 97 into the press-fit slots 94*a*.

In connection, the male connector 1 is mounted on the support bracket 80 by engaging the engaging rail 84 of the support bracket 80 into the dovetail channel 17 of the housing 3 such that the contact point 32*b* of the ground terminal 6 is brought into contact with the contact point 88 of the ground plate 87 while the lance member 20 of the male connector 1 is engaged with the engaging recess 89 of the support bracket 80. Then, the support bracket 80 is attached to the metal pipe 90 by tightening the bolt 91 through the attaching aperture 85 of the support bracket 80 so that the head 91*a* of the attaching bolt 91 is brought into contact with the ground plate 87, thus grounding the ground plate 87 to the metal pipe 90. Consequently, the shield wire 43 of the shielded cable 38 is connected to the ground terminal 6 via the shield jacket 40 and the contact points 30*b*, 31*b*. The ground terminal 6 is connected to the metal pipe 90 via the ground plate 87 and the attaching bolt 91. Thus, the shield wire 38 is grounded to the metal pipe 90.

Then, the fitting portion 52 of the female connector 2 is fitted into the fitting cavity 8 of the male connector 1 such that the male terminals 36 are fitted into the female terminals 66 while the shield jackets 70 of female terminal units 62 are brought into contact with the contact fingers 45 of the male terminal units 1. Simultaneously, the lock bars 59 of the female connector 2 are inserted into the lock bar receiving recess 15 of the male connector 2 such that the engaging member 60 of the lock bars 59 engage the engaging projections 16 for lock. Consequently, the shield wire 73 of the female connector 2 is brought into contact with the shield jacket 40 of the male connector 1 via the shield jacket 70 of the terminal unit 62, which is connected to the ground terminal 6 via the contact points 30*b*, 31*b*. Since the ground terminal 6 is connected to the metal pipe 90 via the ground plate 87 and the attaching bolt 91, the shield wire 73 is grounded to the metal pipe 90.

We claim:

1. An electrical connector assembly comprising:

a support bracket to be attached to a conductive object;

an electrical connector mounted on said support bracket, said electrical connector including:

a dielectric housing;

at least one terminal unit connected to a shield wire of a shielded cable;

a ground terminal in contact with said terminal unit; and a ground plate mounted on said support bracket for interconnecting said ground terminal to said conductive object, thereby grounding said shield wire to said conductive object.

2. An electrical connector assembly comprising:

a support bracket having a connection section and a mounting section to be attached to a conductive object;

an electrical connector mounted on said support bracket, said electrical connector including:

a dielectric housing having a support bracket receiver formed on a first side thereof and connected to said connection section of said support bracket;

a pair of terminal units each mounted is said housing and connected to a shield wire of a shielded cable;

a ground terminal mounted on a second side of said housing and brought into contact with said terminal units;

a ground plate mounted on said support bracket so as to extend from said connection section to the mounting section so that when said electrical connector is mounted on said conductive object via said support bracket, said ground terminal is brought into contact with said ground plate, which is grounded to said conductive object.

3. The electrical connector assembly of claim 2, wherein said connection between said support bracket receiver and said connection section is effected by a dovetail channel and a T-shaped rail.

* * * * *